US007370778B1

(12) United States Patent
Uchikoshi

(10) Patent No.: US 7,370,778 B1
(45) Date of Patent: May 13, 2008

(54) SOLID FINISHING DEVICE FOR JACKETS

(75) Inventor: Mitsuyuki Uchikoshi, Tokyo (JP)

(73) Assignee: Sankousha Engineering Co., Ltd. (JP)

( * ) Notice: Subject to any disclaimer, the term of this patent is extended or adjusted under 35 U.S.C. 154(b) by 0 days.

(21) Appl. No.: 11/685,855

(22) Filed: Mar. 14, 2007

(51) Int. Cl.
*A41H 5/00* (2006.01)

(52) U.S. Cl. ..... 223/70

(58) Field of Classification Search ..... 223/68, 223/69, 70, 57, 51, 73, 76, 79, 74; 38/1 B, 38/14, 20

See application file for complete search history.

(56) References Cited

U.S. PATENT DOCUMENTS 2,969,897 A * 1/1961 Paris ..... 223/67
3,586,219 A * 6/1971 Radford et al. ..... 223/57
4,004,720 A * 1/1977 Cartabbia ..... 223/57
4,303,183 A * 12/1981 Schlemon ..... 223/67
4,423,561 A * 1/1984 Cartabbia ..... 38/23
4,634,030 A 1/1987 Uchikoshi
4,728,015 A * 3/1988 Holzapfel et al. ..... 223/70
4,739,909 A * 4/1988 Bury ..... 223/15
5,265,779 A * 11/1993 Jiang ..... 223/68
5,722,572 A * 3/1998 Pessina ..... 223/70

* cited by examiner

*Primary Examiner*—Gary L. Welch
*Assistant Examiner*—Andrew W Sutton
(74) *Attorney, Agent, or Firm*—Andrus, Sceales, Starke & Sawall, LLP

(57) ABSTRACT

This invention relates to a finishing device in which the jacket (2) is finished while it is put on the torso (1). This invention comprises a pair of front and rear skirt pressers (4) for pressing the front and rear skirts of the jacket (2) put on the torso (1) and a pair of right and left side tension applicators (5) for pushing wide both side skirts of the jacket (2) put on the torso (1) laterally. In this invention, the side tension applicators (5) are provided with side pressers (13) in cooperation with the side tension applicators (5) to hold and press both side skirts of the jacket (2). Application of this invention enables the skirts of the jacket put on the torso to be tensioned under a state in which not only the front and rear sides but also both sides are fixed and further enables the jacket to finished neatly.

6 Claims, 14 Drawing Sheets

SOLID FINISHING DEVICE FOR JACKETS

BACKGROUND OF INVENTION

1. Field of Invention

This invention relates to a solid finishing device for jackets (a jacket, coat or the like) and more particularly a solid finishing device of a type comprising a torso imitating to the chest or breast part of a human body, and using either steam or hot air to remove some wrinkles under a state in which the clothing is put on the torso to perform a smooth finishing.

2. Description of Related Art

As a conventional device of this type, there has been provided a device described in the gazette of U.S. Pat. No. 4,634,030, for example.

The conventional device of this type is provided with a front presser and a rear presser moved forward or rearward to or away from the torso below the front part or rear part of the torso to press the front and rear skirts of a jacket put on the torso. Then, this device lifts up the torso a little after fixing the skirts of the jacket with a pair of front and rear skirt pressers and pulls the jacket in a vertical direction to remove the wrinkles at the front and rear bodices. Accordingly, the conventional device of this type has shown a problem that some torn wrinkles are generated at the clothing ranging from the skirt pressing position to the sides of the jacket because the front and rear skirts are fixed with the skirt pressers.

Thus, it is desirable that the solid finishing device of this type is formed not to generate any such torn wrinkles as above because the torn wrinkles may apply bad influence to the finished state of a jacket.

Further, the conventional device of this type is required that the jacket is arranged at the most suitable height for finishing to press accurately the skirts of the jacket by the skirts presser, and to apply a tension. For this purpose, in the conventional device, the switch of an air cylinder for ascending or descending the torso, were pushed many times by foot or knee to control height of the torso.

Thus, in accordance with the prior art device, this prior art device showed a problem that an efficiency of a jacket finishing operation is reduced because height adjustment for a torso needs a troublesome work.

SUMMARY OF INVENTION

In view of the foregoing problems of the prior art, this invention has been provided. Accordingly, a technical concept of this invention is to provide a device capable of finishing in tension the skirts of a jacket put on a torso under a state in which not only the front and rear parts but also the sides are fixed.

In order to resolve the problem, this invention is constituted as follows.

That is, this invention comprises a pair of front and rear skirt pressers for pressing the front and rear skirts of the jacket put on a torso and a pair of right and left side tension applicators for pushing wide both side skirts of the jacket put on the torso laterally, wherein the side pressers are provided with aforesaid side tension applicators for holding and pressing both side skirts of the jacket in cooperation with the side tension applicators.

Then, this invention has such a configuration as above, so that this invention can prevent some torn wrinkles from being generated on the jacket and finish the jacket neatly.

Further, this invention has some side pressers at the side tension applicators. Accordingly, in the case of this invention, it is not necessary for an exclusive location for fixing side pressers to be arranged below the torso. Due to this fact, in accordance with this arrangement, there are provided some merits that some pipes and accessories or the like can be arranged below the torso and a space below the torso can be effectively utilized.

Thus, the problem that the jacket is arranged at the most suitable height is solved by the following configuration.

The present invention relates to a solid finishing device for jackets comprises a pair of front and rear skirt presser applicators for pressing front and rear skirts of a jacket put on a torso; a pair of right and left side tension applicators for pushing wide both skirts of the jacket put on the torso and applying tension to them; a driving device for ascending or descending the torso; a detector for outputting a signal through passages of skirts of the jacket ascending together with the torso; and a control unit for receiving an output signal from the detector and stopping the ascending of said driving device. Application of this invention enables that the jacket is arranged at the most suitable height and further finishing operation enables the jacket to finished neatly.

Thus, it is preferable that this invention is constituted such that the lower ends of the side tension applicators are provided with hook-like supporting members arranged to be suspended down with the horizontal portions being projected at sides of the torso, the side pressers are pivoted at the horizontal portions of the supporting members with a shaft extending in a forward or rearward direction, and arranged in such a way that they may be turned around the shaft and raised or lowered.

A reason why the foregoing arrangement is preferable consists in the fact that a space occupying the sides for operating the side pressers can be reduced and correspondingly a size of the device can be made small and its occupying space can be made narrow.

In addition, it is preferable in this invention that the torso comprises some collar pressers for use in pressing the lapels of a jacket.

A reason why the foregoing arrangement is preferable consists in the fact that not only the front and rear bodices of the jacket but also the lapels can be finished neatly. In this case, a size of the collar presser is set such that the upper collar of the lapel can be usually pressed.

In addition, in the case of this invention, it is preferable that the collar pressers are formed like a pair of right and left vanes imitating with a shape of butterfly and in such a way that they can be freely opened or closed around the inside pivot shaft by a predetermined angle in a forward or rearward direction of the torso.

A reason why the foregoing arrangement is preferable consists in the fact that both lapels can be pressed with both hands to wrap them in and a finished state of the lapels can be improved more. In this case, the inside pivot shaft is meant by a shaft arranged at the central part or a location near the central part so as to enable the opening or closing operation of the pair of right and left vane-like collar pressers. More practically, it can be realized by arranging one (one piece) collar presser or arranging a pair of right and left collar pressers at linear symmetrical positions. In addition, the predetermined angle is meant by an angle in which each of the right and left collar pressers is turned in an inward or outward direction around the front side pivot shaft of the torso to enable the lapels to be pressed.

DESCRIPTION OF PREFERRED EMBODIMENTS

Figure 1:
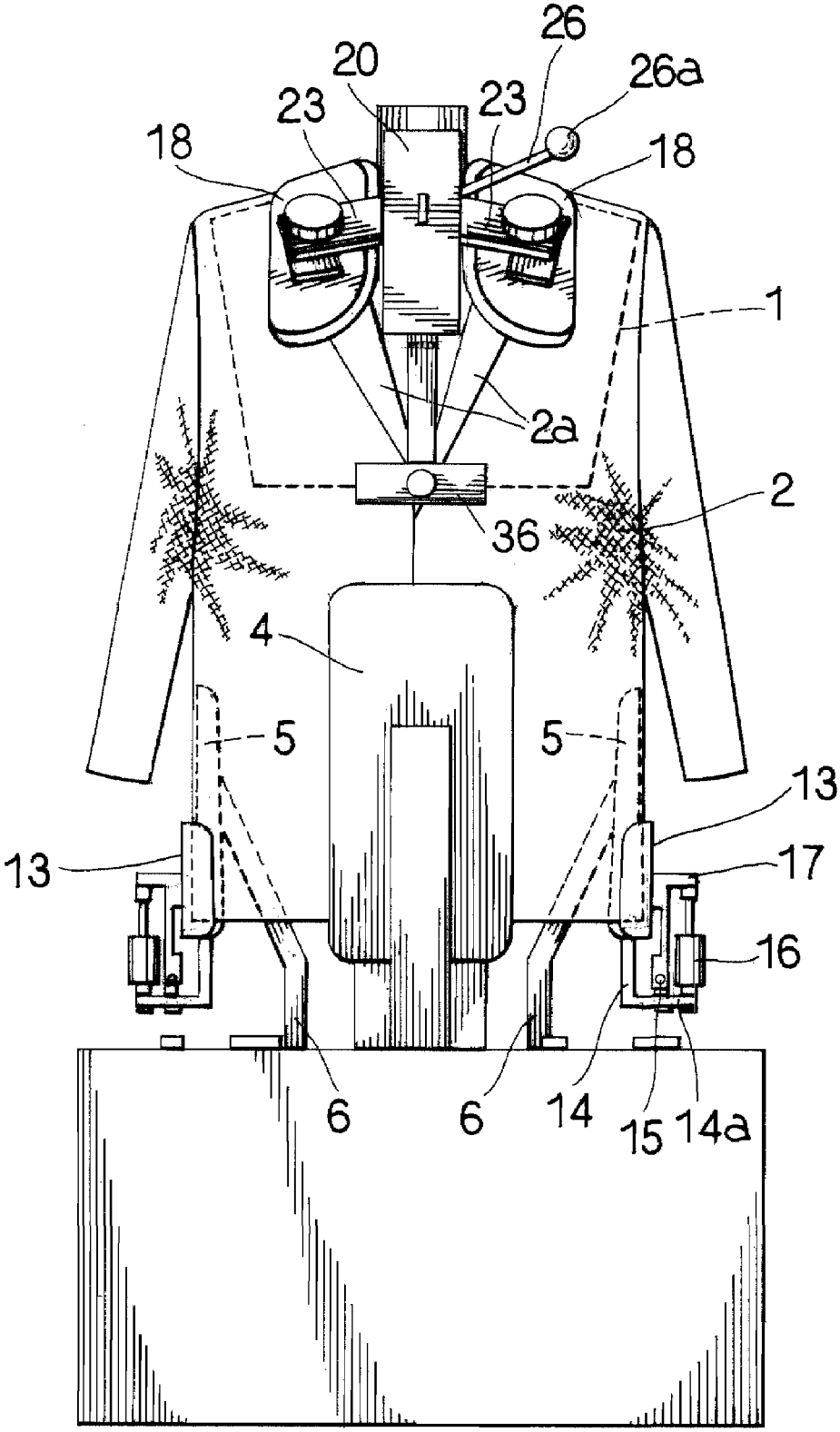
FIG. 1 is a front elevational view for showing one preferred embodiment of a solid finishing device of the present invention in its using state.

Referring now to the drawings, the preferred embodiment of the present invention will be described as follows.

Figure 2:
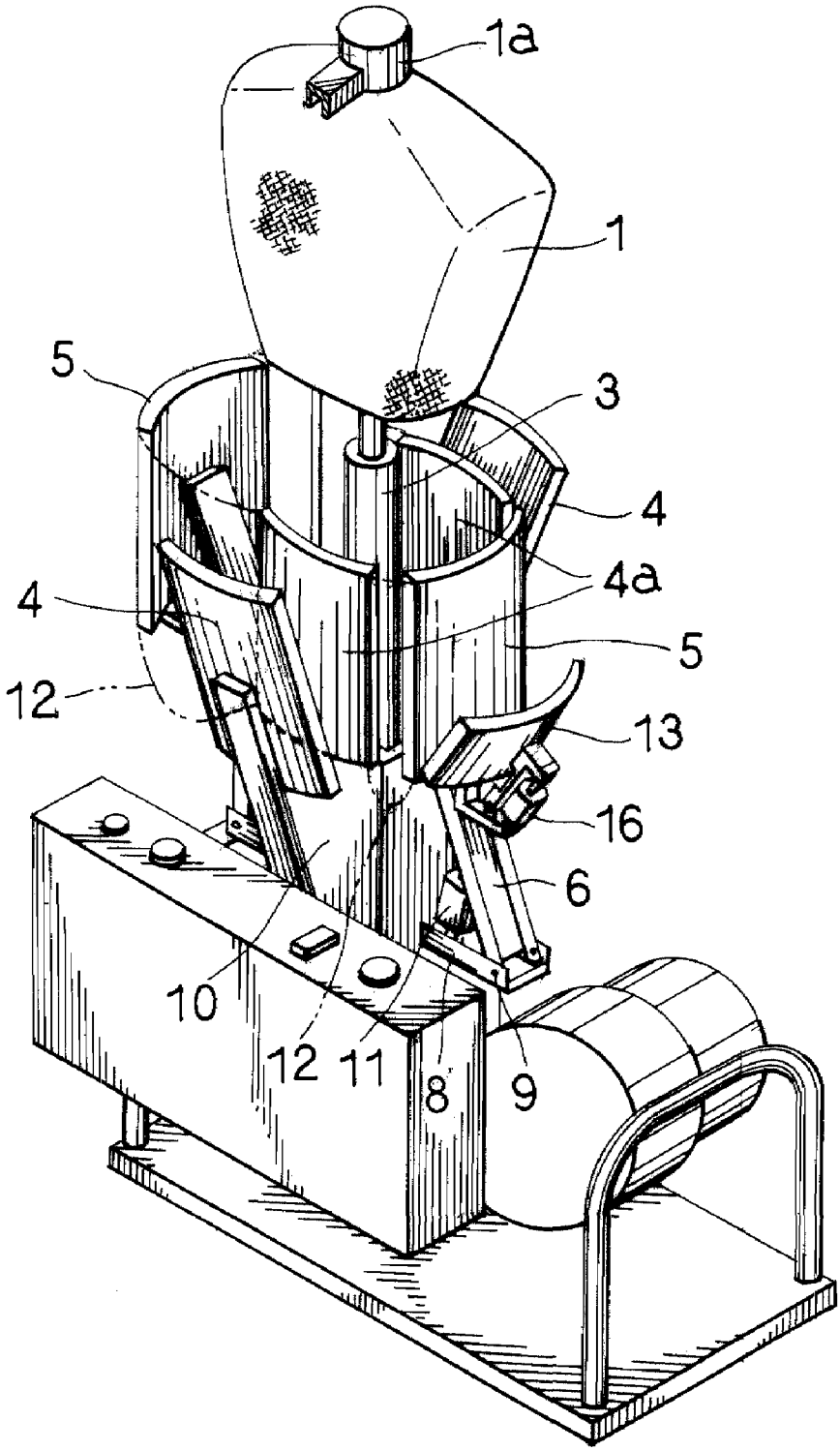
FIG. 2 is a substantial perspective view for showing the solid finishing device.

As shown in FIGS. 1 and 2 or the like, reference numeral 1 denotes a torso imitating a chest part (a breast part) of a human body and reference numeral 2 denotes a jacket put on the torso 1. The torso 1 is formed in such a way that it can be freely ascended or descended through an extending or retracting action of a rod in a first air cylinder acting as the driving device 3. Reference numeral 4 denotes a pair of front and rear skirt pressers for use in pressing the front and rear skirts of the jacket 2.

Figure 3:
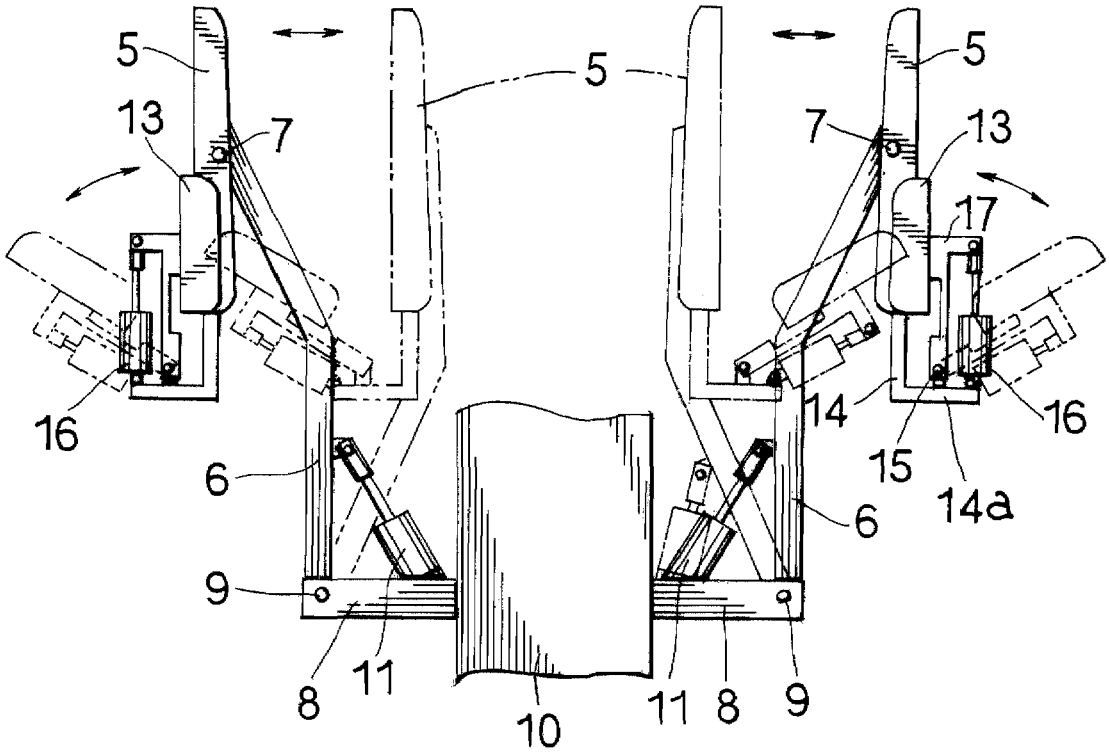
FIG. 3 is a substantial front elevational view for illustrating an action of the solid finishing device.

Reference numeral 5 denotes a pair of right and left side tension applicators for use in pushing wide both skirts of the jacket 2 put on the torso 1 in an outward direction to apply a tension to each of the sides of the skirt. As shown in FIGS. 2 and 3 or the like, the side tension applicators 5 are pivoted at the upper parts of raised frames 6 through the first lateral shafts 7 extending along the forward and rearward directions. The lower ends of the raised frames 6 are pivoted to the outer ends of the lateral-directed supporting frames 8 through the second lateral shafts 9 extending along the forward and rearward directions. The inner ends of the supporting frames 8 are fixed to the side surfaces of a rectangular-shaped base frame 10.

The aforesaid first air cylinder 3 is installed inside the base frame 10. In addition, each of the raised frames 6 is formed into a bent shape with the lower part inclined from the position of the second lateral shaft 9 to the base frame 10 and the vertical upper part communicated with the lower part.

Figure 4:
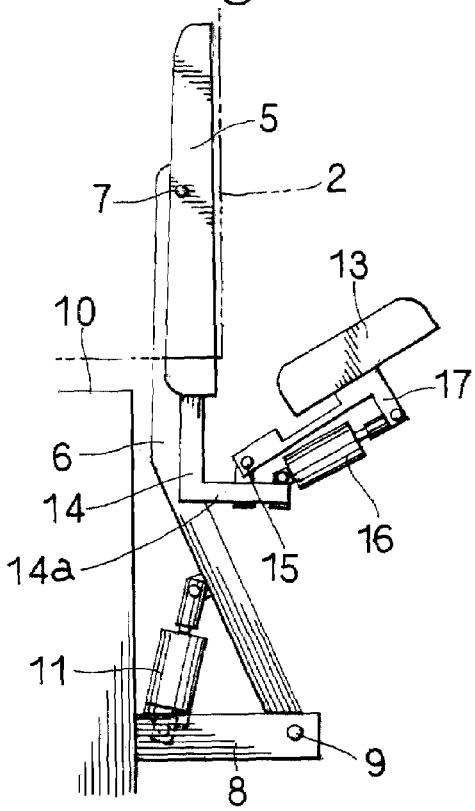
FIG. 4 is a substantial front elevational view for illustrating an action of the solid finishing device.
Figure 5:
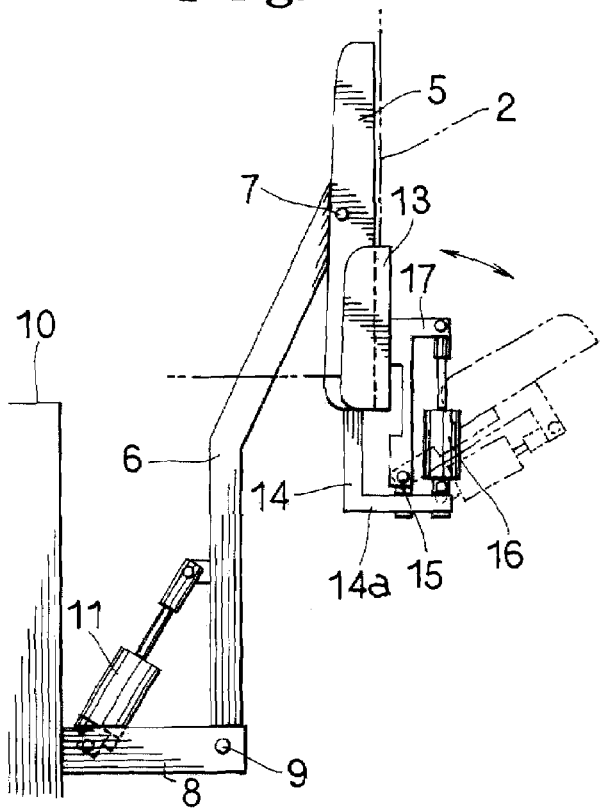
FIG. 5 is a substantial front elevational view for illustrating an action of the solid finishing device.

Reference numeral 11 denotes the second air cylinders installed in a slanted manner between the lower part of each of the raised frames 6 and each of the supporting frames 8 with their rods being inclined outward. When the rods of the second air cylinders 11 are extended, the raised frames 6 are turned laterally around the second lateral shafts 9 to cause the skirt and side portions of the jacket 2 to be pushed wide laterally and apply a certain tension to them (refer to FIGS. 3 to 5).

Further, as shown in FIG. 2, heat-resistant cloths 12 are tensioned between each of receiving irons 4*a* of the skirt pressers 4 and the side tension applicators 5 with a margin in such a way that a motion of the side tension applicators 5 may not be restricted and are formed for not to dispel steam and hot air supplied into the inside portion of the jacket 2.

Reference numeral 13 denotes side pressers cooperating with the side tension applicators 5 to hold the side skirts of the jacket 2 and press them. The side pressers 13 are installed at the side tension applicators 5.

Reference numeral 14 denotes a hook-shaped supporting member. The supporting member 14 is formed such that its horizontal portion 14*a* is projected at the side part of the torso 1 below the lower end of the side tension applicator 5 and arranged in a suspended state. The side presser 13 is pivoted at the horizontal part 14*a* of the supporting member 14 with the shaft 15 extending in a forward or rearward direction and arranged in such a way that it may be turned around the shaft 15 so as to be freely raised or lowered.

Reference numeral 16 denotes a third air cylinder for raising or lowering the side presser 13. The third air cylinder 16 is pivoted between the horizontal part 14*a* of the supporting member 14 and a projecting part 17 at the rear surface side of the side presser 13 so as to cause the rod to become in parallel with the front surface (the pressing surface) of the side presser 13, and the third air cylinder 16 is also formed to be raised or lowered together with the side presser 13 when the rod of the third air cylinder 16 is extended or retracted.

In addition, reference numeral 18 (refer to FIGS. 1 and 6 or the like) denotes a collar presser for use in pressing a lapel 2*a* of the jacket 2. The collar pressers 18 are formed as a pair of right and left vanes similar to a shape of butterfly and further formed in such a way that they can be opened or closed by a predetermined angle in a forward or rearward direction of the torso 1 around the inner pivoted shaft 19 (refer to FIGS. 9 and 10 or the like).

A pair of right and left pivoted shafts 19 are arranged as seen from their top plan view at an upper plate 21 and a lower plate 22 fixed inside a fixing part 20 projected like a hook-like handle from a neck part 1*a* of the torso 1 (refer to FIG. 8) to the forward direction in this preferred embodiment.

Arm pieces 23 for supporting collar pressers 18 (refer to FIGS. 1 and 9 or the like) are pivoted with the pivot shafts 19 to the upper plate 21 and the lower plate 22 at their inner ends. The collar pressers 18 are arranged at the outer ends of the arm pieces 23 in such a way that their pressing forces may be adjusted by adjusting resiliency of coil springs 25 with knobs 24.

Reference numeral 26 denotes a lever for use in opening or closing the collar pressers 18 by a predetermined angle. The outer end of this lever 26 is provided with a spherical knob 26*a*, and its inner end is connected to a hook-like extended plate 27 as seen from its top plan view. This extended plated 27 is pivoted to the upper plate 21 through a vertical shaft 28, slightly spaced apart from the upper plate 21 and arranged over it in parallel with the upper plate 21. In addition, an inner corner at the extremity end of the extended plate 27 is cut into a concave curved shape and formed at a recess part 27*a*.

Reference numeral 21*a* denotes a guide hole that is formed as an arcuate shape as seen from its top plan view. A shaft rod 29 is passed through the guide hole 21*a* and a rotor 30 is fixed to the upper end of the shaft rod 29.

The inner peripheral edge 27*b* of the extended plate 27 is formed to be engaged with the outer peripheral surface of the rotor 30. In addition, the recess part 27*a* is extended from the inner peripheral edge 27*b*, engaged with the rotor 30 to receive the rotor 30. In addition, the shaft rod 29 is always towed against the side of the torso 1 by a tension spring 31.

Figure 8:
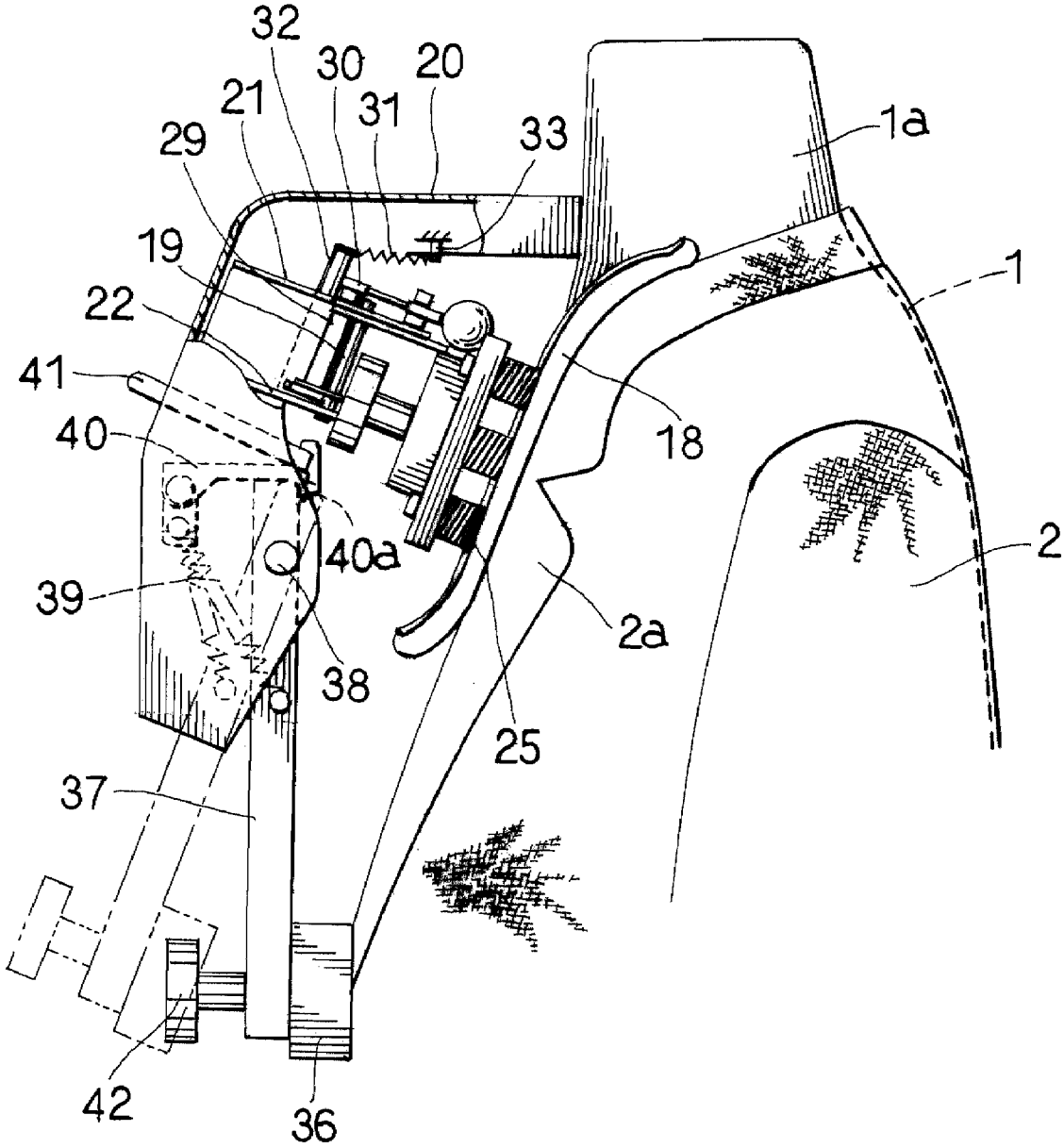
FIG. 8 is a substantial side elevational view with a part of the solid finishing device being broken away.

Reference numeral 32 (refer to FIG. 8 or the like) denotes a spring fixing member connected to the shaft rod 29. The tension spring 31 is applied between the upper end of the spring fixing member 32 and a pin 33 fixed to the inner side upper surface of a fixing part 20.

Figure 9:
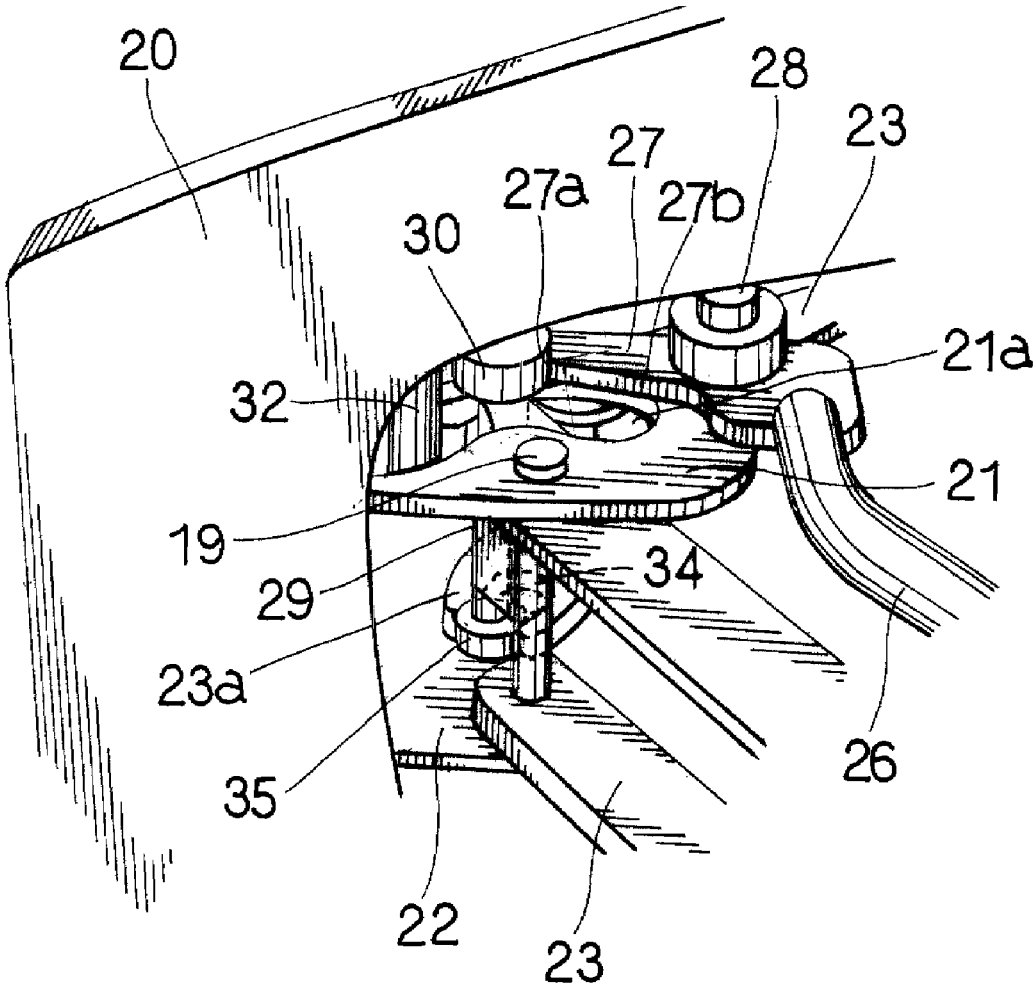
FIG. 9 is a substantial perspective view for showing the solid finishing device.
Figure 10:
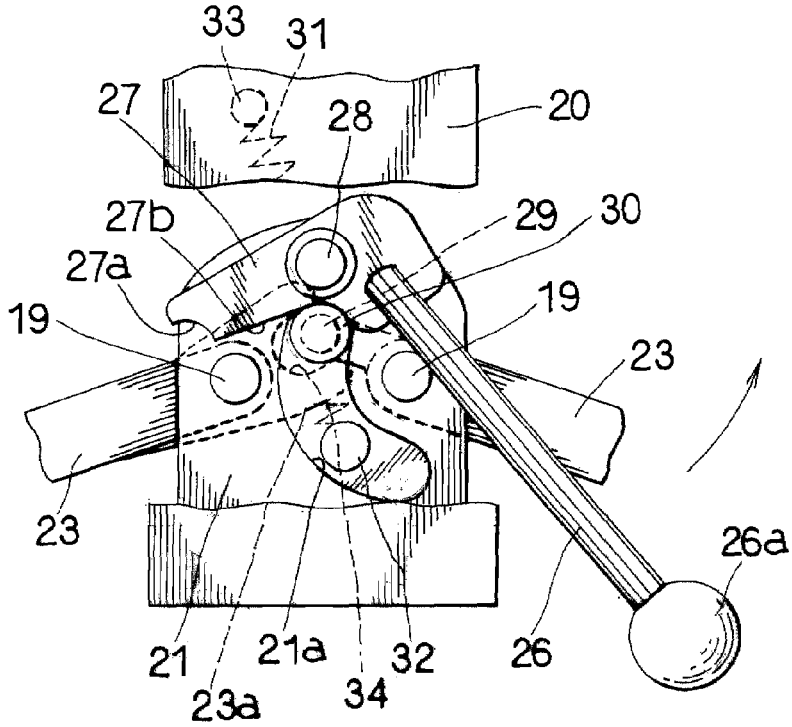
FIG. 10 is a substantial top plan view with a part being broken away for illustrating an action of a collar presser.

As shown in FIGS. 9 and 10 or the like, the inner end of one arm piece 23 (the right arm piece 23 in FIG. 1 of this preferred embodiment) is extended up to a position of the shaft rod 29 and connected integral with the shaft rod 29.

In addition, a lower location 23*a* (refer to FIG. 9 or the like) at the inner end of the other arm piece 23 (the left arm piece 23 in FIG. 1) is extended up to a position of the shaft rod 29 and at the same time it is formed to have a recess 34 having a U-shaped section as seen in its top plan view. Then, the other arm piece 23 is formed to be cooperated with the shaft rod 29 while the recess 34 is being engaged with the outer peripheral surface of the lower rotor 35 at the lower end of the shaft rod 29.

In addition, reference numeral 36 (refer to FIGS. 1 and 8 or the like) denotes a lower part presser for use in pressing the lower part of the lapel 2*a*. This lower presser 36 is installed at the lower end of the rod member 37. The upper part of the rod member 37 is pivoted to the fixing part 20 through a third lateral shaft 38 extending along the right and left directions of the torso 1. With this arrangement, the lower presser 36 is formed to be turned around the third lateral shaft 38 by a predetermined angle in a forward or rearward direction of the torso 1.

In addition, the rod member 37 is hauled upward with the coil spring 39 and when an operator turns the lower presser 36 toward the torso 1 against the retracting force of this coil spring 39 and against the lower part of the lapel 2*a*, the rod member 37 is formed to cause its upper end to be engaged with a claw 40*a* of an engaging hook 40.

The claw 40*a* of the engaging hook 40 is formed to be disengaged from the upper end of the rod member 37 by depressing the extremity end of an operating piece 41 projected from the front surface of the fixing part 20. Then, when the claw 40*a* is disengaged from the upper end of the rod member 37, the lower presser 36 is turned around the third lateral shaft 38 to the front part of the torso 1 with the recovering force of the soil spring 39 and pulled away. Further, reference numeral 42 denotes an operating knob for the lower presser 36.

Next, an example of action of the present invention will be described as follows.

At first, the operator puts the jacket 2 on the torso 1 while adjusting the positions of its shoulders and subsequently treads on a lifting pedal for the torso 1, for example. Then, the rod of the first air cylinder 3 extends to cause the jacket 2 to be lifted up together with the torso 1. In this case, when a skirt sensor (not shown) arranged at a proper location detects a passage of the skirt, for example, after elapsing a predetermined time, driving of the first air cylinder 3 is stopped, and with this arrangement, the jacket 2 is arranged at the most suitable height.

Next, the operator under this state fixes the lapel 2*a* with the collar presser 18. More practically, the operator in FIG. 10 turns the lever 26 in a counter-clockwise direction (in an arrow direction) against a retraction force of the tension spring 31. Then, the extended plate 27 is turned around the vertical shaft 28 in the same direction as that of the former, so that the rotor 30 engaged with the inner peripheral edge 27*b* is gradually moved downward in this figure while being pushed with the inner peripheral edge 27*b*. The rotor 30 is made integral with the shaft rod 29, and the shaft rod 29 and one arm piece 23 (the right arm piece 23 in this figure) are connected to each other. Accordingly, as the rotor 30 is moved, the shaft rod 29 is guided by the guide hole 21*a* and moved, one arm piece 23 is turned around the pivot shaft 19 in a counter-clockwise direction and the right collar presser 18 is gradually turned to the side of the torso 1.

Figure 11:
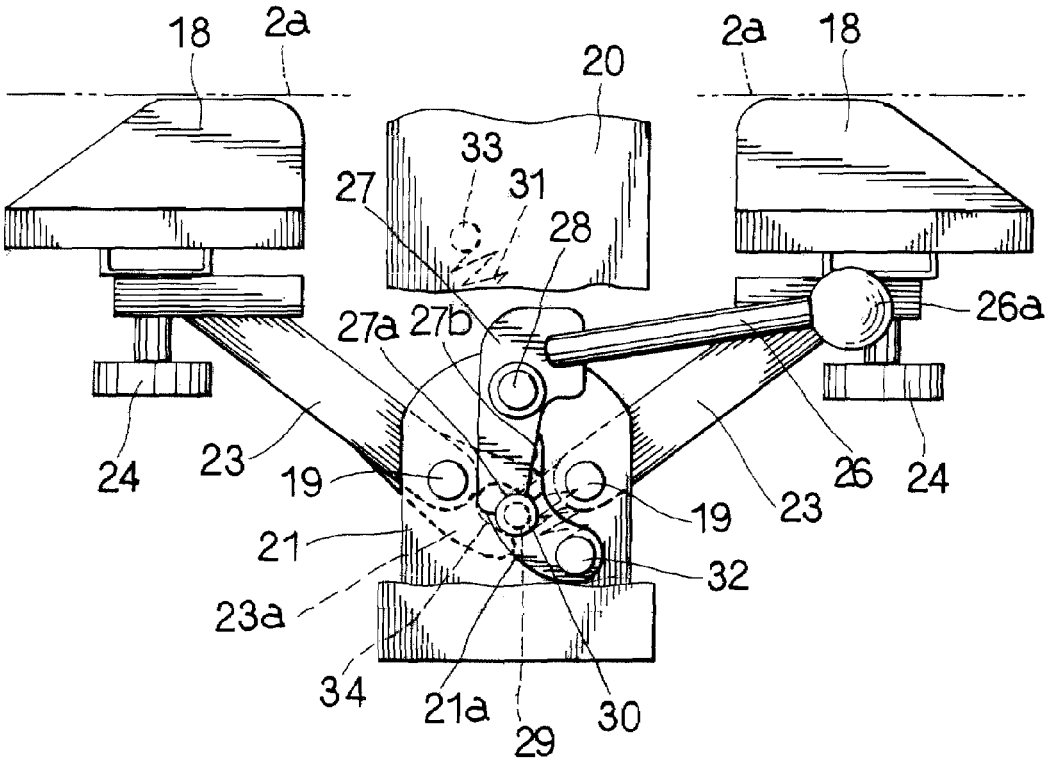
FIG. 11 is a substantial top plan view with a part being broken away for illustrating an action of a collar presser.

Then, as the operator pushes the lever 26 to its final turning position, the recess 27*a* of the extended plate 27 is engaged with the rotor 30 as shown in FIG. 11. At this time, the right collar presser 18 presses against the right lapel 2*a*. In addition, as described above, the left arm piece 23 is engaged with the lower rotor 35 where the recess 34 at the lower location 23*a* is made integral with the shaft rod 29. Accordingly, when the operator turns the lever 26 in a counter-clockwise direction as seen in FIG. 10, the left arm piece 23 is turned around the left pivot shaft 19 in a clockwise direction as the shaft rod 29 is moved toward a direction where it is moved away from the torso 1 (in the downward direction in this figure). Then, as the recess 27*a* of the extended plate 27 is engaged with the rotor 30 (refer to the state shown in FIG. 11), the left collar presser 18 presses against the left lapel 2*a*. In the present invention, the right and left collar pressers 18 simultaneously press against the right and left lapels 2*a* in this manner.

Further, in the case that the collar pressers 18 are moved away from the lapel 2*a*, the operator operates the lever 26 in a manner opposite to the aforesaid example. That is, the operator draws the lever 26 and turns the lever 26 in a clockwise direction as seen in FIG. 11. Then, the engaged state between the rotor 30 and the recess 27*a* is released and subsequently the rotor 30 is moved gradually toward the torso 1 (in an upward direction in this figure) with the recovering force of the tension spring 31 while being contacted with the inner peripheral edge 27*b* of the extended plate 27. Accordingly, when the shaft rod 29 is moved in the same direction as that of the lever together with the rotor 30 and the operator pulls the lever 26 toward the operator, the right and left arm pieces 23 are turned around the right and left pivot shafts 19 in a direction opposite to that described above and opened in an outward direction as shown in FIG.

Figure 6:
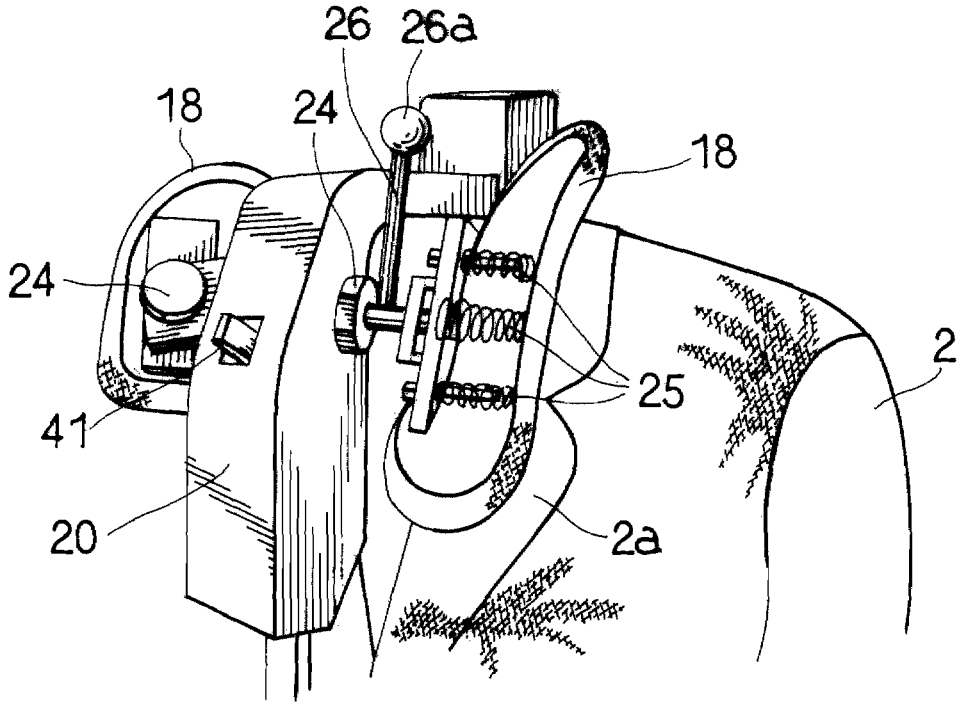
FIG. 6 is a substantial perspective view for showing the solid finishing device.
Figure 7:
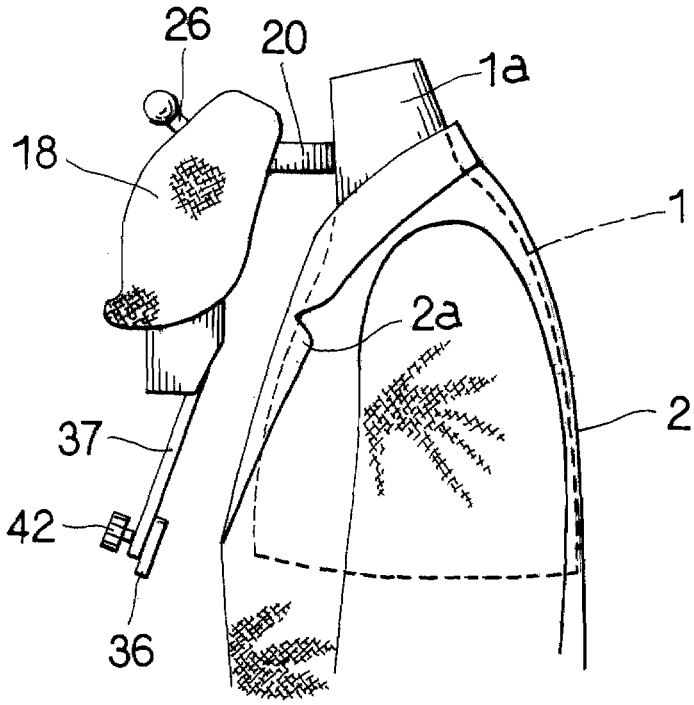
FIG. 7 is a substantial side elevational view for showing the solid finishing device.

10. With this arrangement as above, the right and left collar pressers 18 are moved away from the lapels 2*a* as shown in FIGS. 6 and 7.

Thus, after the lapels 2*a* are fixed by the collar pressers 18, the operator pushes the operation knob 42 (refer to FIG. 8) against the retraction force of the coil spring 39 and fixes the lower portions of the lapels 2*a* with the lower presser 36. At this time, the claw 40*a* of the engaging hook 40 is engaged with the upper end of the rod member 37 and the lower presser 36 is fixed.

Then, the operator depresses an automatic start button, for example. Then, the collar presser 4 fixes the forward and rearward skirts of the jacket 2 in an order of a rear side and front side, subsequently the right and left side tension applicators 5 are moved simultaneously to the sides to push wide both skirts of the jacket 2 and apply a tension to them. After this operation, the side pressers 13 press both side skirts against the side tension applicators 5 simultaneously and fix them.

The skirts are fixed in this way, and after this operation, the first air cylinder 3 (refer to FIG. 2), for example, is operated to cause its rod to be slightly lifted up to lift up the torso 1 and the jacket 2 is pulled and tensioned in a vertical direction. Then, both steam and hot air are blown against inside portion of the jacket 2 to steam the jacket 2 to extend its wrinkles and dry finish it.

After this operation, when the operator depresses a finish button, for example, the rod of the first air cylinder 3 is retracted and the torso 1 descends and returns to its set position. In addition, the rods in the second air cylinder 11 and the third air cylinder 16 are retracted and the side tension applicators 5 are returned inwardly and at the same time the side pressers 13 are turned outwardly to release the depressed states of both skirts, and subsequently the pair of front and rear skirt pressers 4 are recovered to release the fixed state of the skirts.

After this operation, the operator operates the lever 26 (refer to FIG. 1) in an opposite manner to that described above, depresses down the operating piece 41 (refer to FIG. 8) so as to recover the collar pressers 18 and the lower part presser 36. Then, the operator puts off the jacket 2 from the torso 1 and completes the finishing operation.

Subsequently, the most preferred embodiment of the present invention described in claim 7 will be described in reference to FIG. 12 and the like. In the figures subsequent to FIG. 12, the aforesaid collar presser 18 is eliminated. However, it is of course apparent that the device of the present invention is provided with the collar presser 18.

Figure 12:
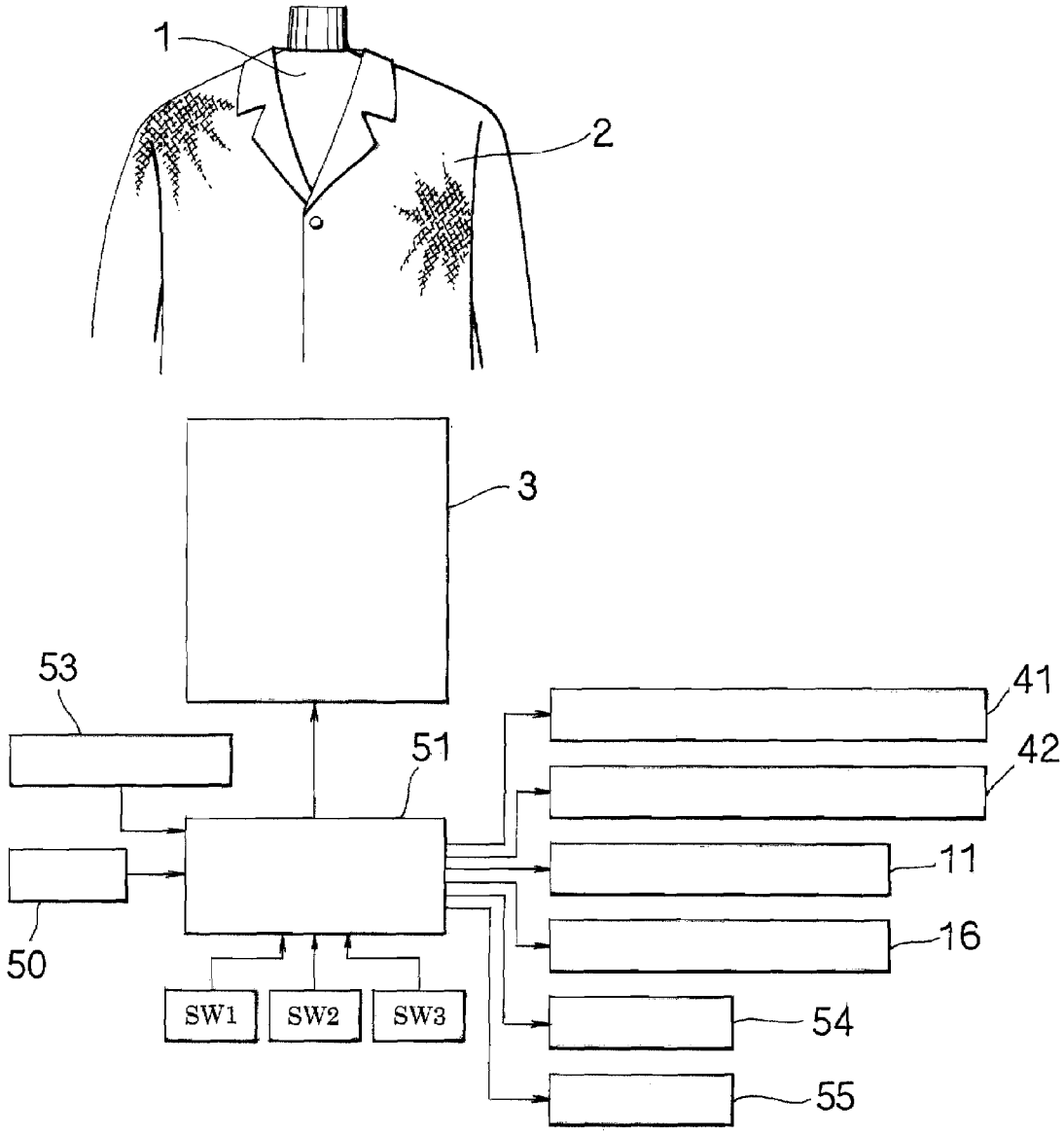
FIG. 12 is the configuration view of the device of this invention which enables to arrange the jacket at the most suitable height.

In FIG. 12 and the like, reference numeral 1 denotes a torso and reference numeral 2 denotes a jacket put on the torso. The torso 1 is formed to be freely ascendable or descendable with the first air cylinder acting as a driving device 3 in this preferred embodiment.

Figure 13:
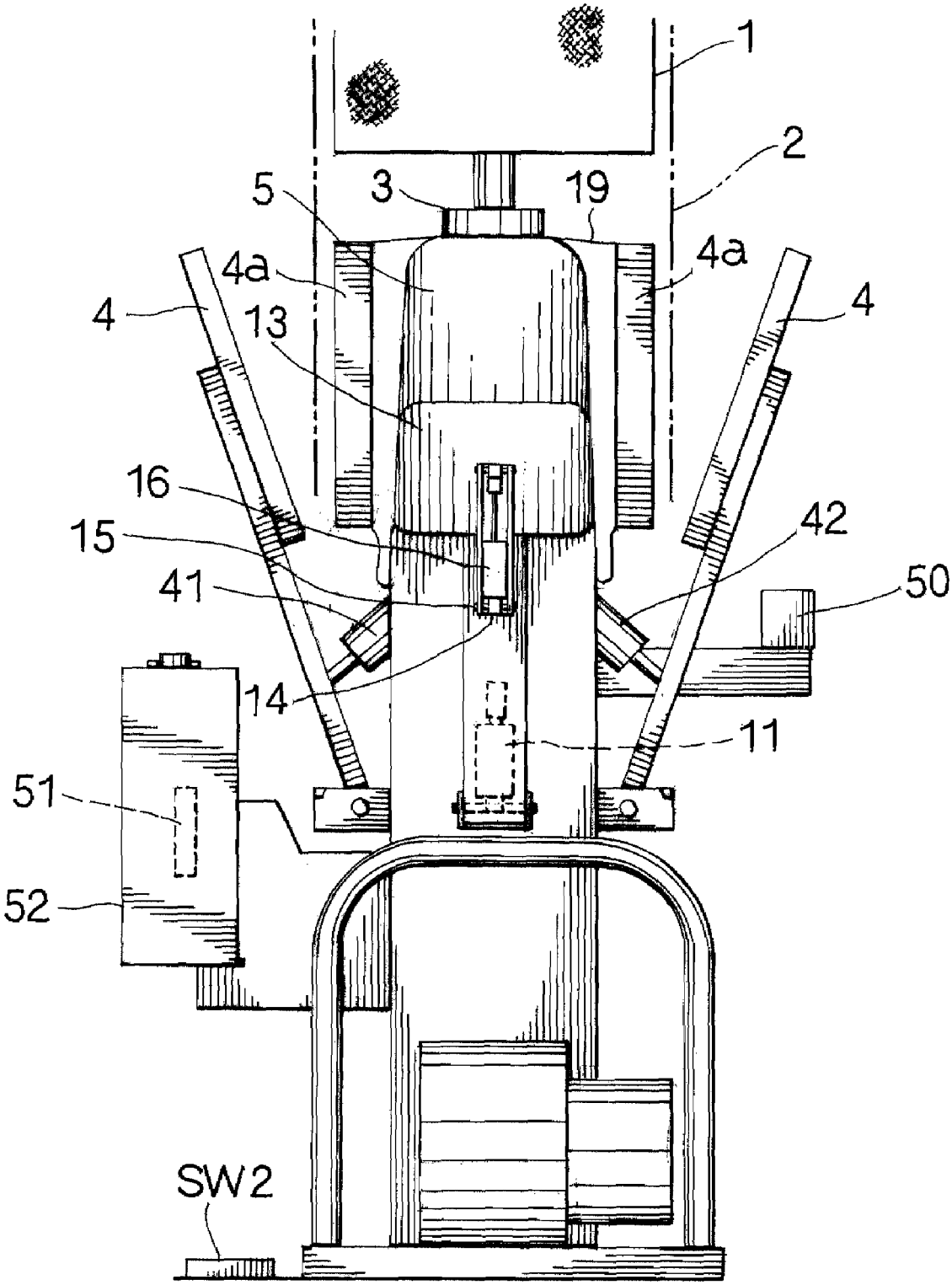
FIG. 13 is the substantial side elevational view of the device of this invention which enables to arrange the jacket at the most suitable height.

Reference numeral 50 denotes a detector for outputting a signal while a skirt of the jacket 2 passes through it. This detector 50 in this preferred embodiment is constituted by an optical sensor and as shown in FIG. 13, the detector 50 is installed at the rear lower side of the torso 1. This detector 50 outputs a signal when the jacket 2 ascends together with the torso 1 and the skirt passes through an optical path.

Reference numeral 51 denotes a control unit for receiving an output signal from the detector 50 and stopping an ascending action of a rod of the first air cylinder acting as a driving device 3. This control unit 51 in this preferred embodiment is constituted by a micro-computer and stored in a control panel 52 (refer to FIG. 13 and FIG. 14) placed at the front lower part of the torso 1. To the input ports of the control unit 51 are electrically connected an auto-start button (SW1), an ascending pedal (SW2) for the torso 1, a finish button (SW3) and a timer setting unit 53 and the like in addition to the aforesaid detector 50. In addition, to the output ports of the control unit are electrically connected the first air cylinder acting as the driving device 3, a steam generating device 54 for steaming the jacket 2 put on the torso 1, a hot air generating device 55 for drying and finishing the jacket 2 and various types of air cylinder to be described later.

Figure 14:
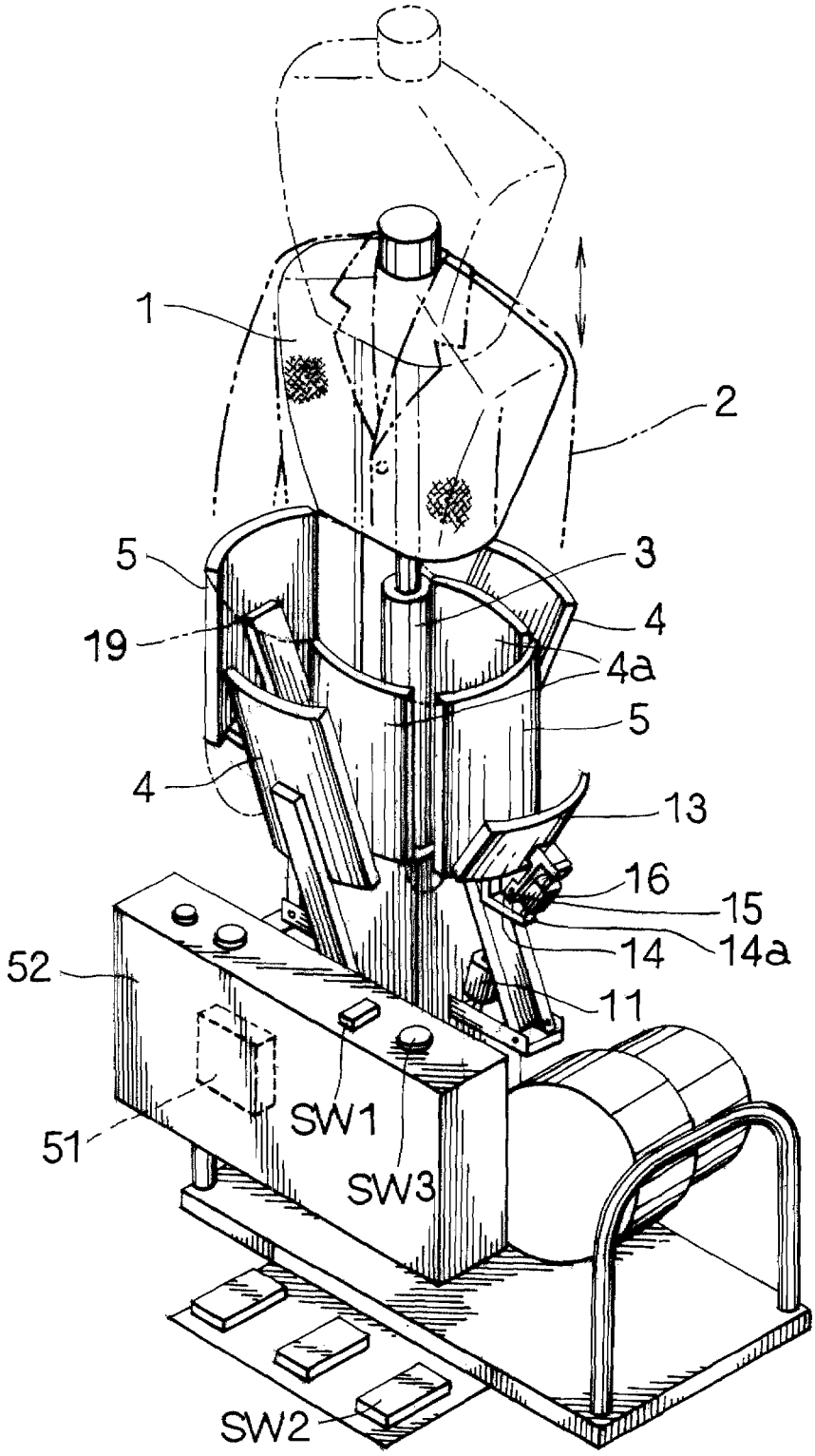
FIG. 14 is the substantial perspective view of the device of this invention which enables to arrange the jacket at the most suitable height.

As indicated in FIG. 13 and FIG. 14, the device of the present invention is constructed such that a pair of front and rear skirt pressers 4 for use in pressing the front and rear skirts of the jacket 2 at the front side and the rear side of the torso 1. Reference numeral 41 denotes a front side skirt pressing air cylinder and reference numeral 42 denotes a rear side skirt presser air cylinder. In addition, the device of the present invention in accordance with this preferred embodiment is formed to be provided with a pair of right and left side tension applicators 5 for use in pushing wide both side skirts of the jacket 2 put on the torso 1, and side pressers 13 for use in pushing wide both skirts of the jacket 2 put on the torso 1 outward and applying tension to them. The side tension applicators 5 move forward and rearward in response to an extending or retracting operation of the rod in the second air cylinder 11 for applying side tensions. Reference numeral 14 (refer to FIG. 14) denotes a hook-shaped supporting member as seen in its front elevational view. This supporting member 14 is arranged at the lower end of each of the side tension applicators 5 in a suspended manner. Then, the side pressers 13 are arranged at the horizontal part 14*a* of the supporting member 14 through a shaft 15 (refer to FIG. 13) in such a manner as they are raised or lowered. Reference numeral 16 denotes the third air cylinder for raising or lowering the side pressers 13. Further, a heat-resistant cloth 19 is tensioned among the receiving irons 4*a* of a pair of front and rear skirt pressers 4 and the side tension applicators 5 with a surplus state so as not to apply any restriction against motion toward the side tension applicators. With this arrangement, dispersion of steam and hot air supplied into the jacket 2 is prevented.

Figure 15:
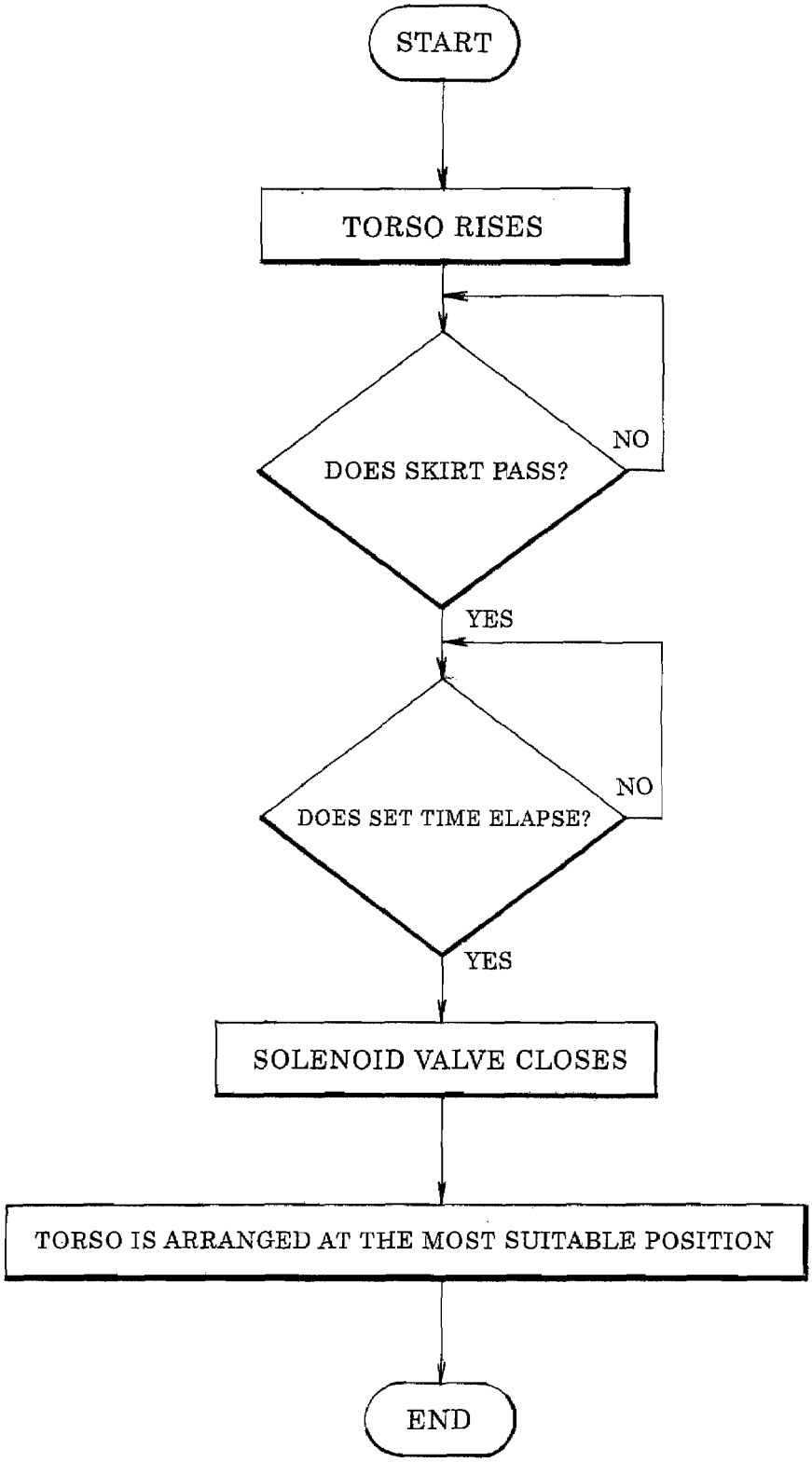
FIG. 15 is the flow chart for illustrating an action of the device of this invention which enables to arrange the jacket at the most suitable height.

Referring now to FIGS. 15 to 17, one example for finishing the jacket 2 by the device of the present invention will be described.

Normally, as the jacket 2, there are a short jacket such as a suite and a jacket and a longer one such as a coat and the like. The short jacket 2 shows an advantage that the center of the jacket 2 is relatively hardly displaced from the center of the torso 1 when the jacket is arranged at the position where it is most suitable for finishing work. Accordingly, in this case, approximate all the steps can be carried out automatically by depressing the auto-start button (SW1) after the jacket 2 is put on the torso 1 as shown in FIG. 16.

Figure 16A:
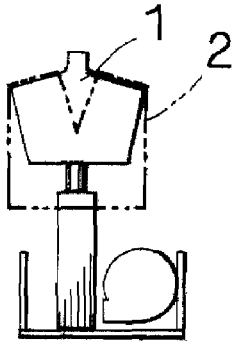
FIGS. 16A to 16D are process view for illustrating arranging of an operation of the device of this invention which enables to arrange the jacket at the most suitable height.
Figure 16B:
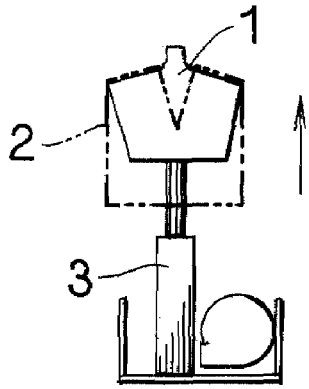
Figure 16C:
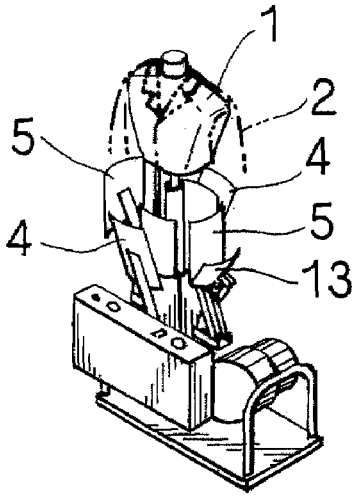

That is, a worker at first puts the jacket 2 on the torso 1 and applies a tension at the shoulders (refer to FIG. 16A). Then, the worker depresses the auto-start button (SW1). Then, the rod of the first air cylinder acting as the driving device 3 extends in response to a signal from the control unit 51 and the torso 1 ascends.

In this way, when the worker puts the jacket 2 on the torso 1, the optical path of the detector 50 is shut off with the rear bodice of the jacket 2. Then, when the jacket 2 ascends together with the torso 1 and the skirt passes through the optical path, its amount of light varies to cause the detector 50 to turn on. The control unit 51 receives this signal and upon elapsing of set time (for example, 2 seconds) preset at a timer setting unit 53, the control unit 50 closes the solenoid valve to cause an ascending action of the rod in the first cylinder acting as the driving device 3 to be stopped. With this arrangement as above, the jacket 2 in the present invention is arranged at the most suitable finishing height (refer to FIG. 16B).

Then, the device of the present invention drives, under this state, the rear side skirt presser air cylinder 42 (refer to FIG. 13) and the front side skirt presser air cylinder 41 (refer to FIG. 13). With this arrangement as above, the front and rear skirts of the jacket 2 are fixed by the skirt pressers 4 in an order of the front side and rear side. In addition, subsequently, the side tension air cylinder 11 is driven to cause the side tension applicators 5 to move side and both skirts of the jacket 2 are pushed wide, thereafter the side presser air cylinder 16 is driven. With this arrangement as above, the side pressers 13 push both skirts against the side tension applicators 5 and fix them. Then, the jacket 2 is steamed with steam supplied from the steam generating device 54 and the rod in the first air cylinder acting as the driving device 3 slightly ascends to cause the jacket to be extended in a vertical direction and some wrinkles there are removed. After this operation, hot air from the hot air generating device 55 is blown into the jacket 2 so as to dry finish it (refer to FIG. 16C).

Figure 16D:
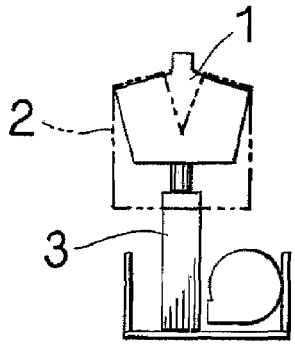

Then, when the worker depresses the finish button (SW3), for example, an air flow passage switching-over signal is sent from the control unit 51 to the solenoid valve to cause the rod in the torso air cylinder to be retracted, the jacket 2 descends together with the torso 1 and returns-back to the set position (refer to FIG. 16D). The worker, under this state, takes off the jacket 2 from the torso 1 to complete the finishing work.

Then, referring to FIG. 17, the finishing work for the long coat and the like will be described as follows.

Figure 17A:
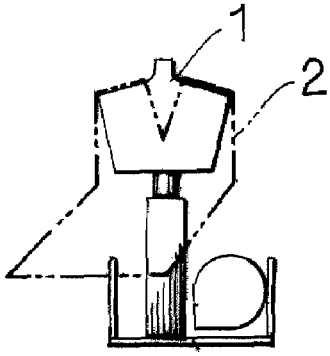
FIGS. 17A to 17D are process view for illustrating arranging of an operation of the device of the present invention which enables to arrange the jacket at the most suitable height.
Figure 17B:
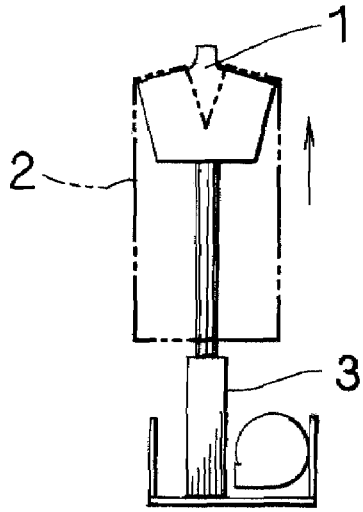
Figure 17C:
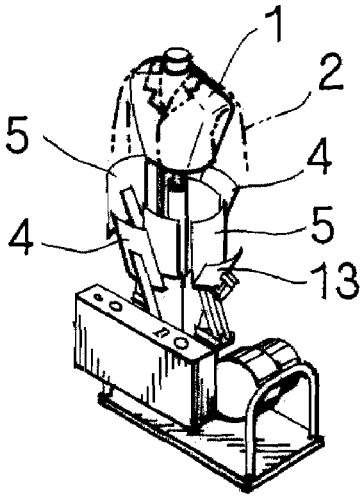
Figure 17D:
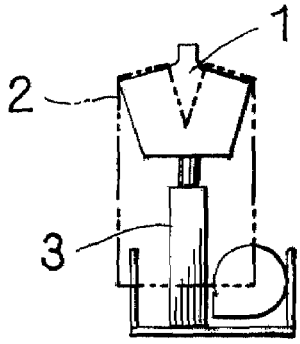

At first, the worker puts the jacket 2 on the torso 1 in the same manner as that described above and applies a tension against the shoulders of the jacket 2 (refer to FIG. 17A). Next, the worker treads on the ascending pedal (SW2) for the torso 1. Then, the rod in the first air cylinder acting as the driving device 3 extends in the same manner as described above and the torso 1 ascends. Then, when the detector 50 detects the skirts of the jacket 2 ascending together with the torso 1, the detector may output a signal to the control unit 51. The control unit 51 receives this signal and when a set time elapses, the ascending of the rod in the first air cylinder is stopped. With this operation, the jacket 2 is arranged at the most appropriate finishing height (refer to FIG. 17B). In this case, when the center of the jacket 2 is displaced from the center of the torso 1, the worker manually aligns the center of the jacket 2 with the center of the torso 1.

Then, the worker depresses the auto-start button (SW1). Then, the skirts of the jacket 2 are fixed in the same manner as described above in the order of front side and rear side, both sides of the jacket 2 are tensioned by the side tension applicators 5 toward sides and at the same time both skirts are fixed with the side presser applicators 13. After this operation, the jacket 2 is steamed with steam, the torso 1 slightly ascends, the jacket 2 is pulled in a vertical direction to extend some wrinkles and dry finished with steam (refer to FIG. 17C). Then, the worker depresses the finish button (SW3). With this operation, the torso 1 descends and the jacket 2 returns back to its set position (refer to FIG. 17D). The worker takes off the jacket 2 from the torso 1 under this state and removes it.

What is claimed is:

1. A solid finishing device for jackets comprising:

a pair of front and rear skirt presser applicators for pressing front and rear skirts of a jacket put on a torso;

a pair of right and left side tension applicators for pushing wide both skirts of the jacket put on the torso and applying tension to them;

a driving device for ascending or descending the torso;

a detector for outputting a signal through passages of skirts of the jacket ascending together with the torso; and a control unit for receiving an output signal from the detector and stopping the ascending of said driving device.

2. The solid finishing device for jackets according to claim 1, wherein hook-shaped supporting members are arranged to be suspended at the lower ends of the side tension applicators while their horizontal portions being protruded to the sides of the torso, side pressers are pivoted through a shaft extending in a forward or rearward direction at the horizontal portions of the supporting members and they are arranged to be turned around the shaft to be enabled freely to rise or fall.

3. The solid finishing device for jackets according to claim 1, wherein the torso is formed to be provided with collar pressers for pressing lapels of the jacket.

4. The solid finishing device for jackets according to claim 2, wherein the torso is formed to be provided with collar pressers for pressing lapels of the jacket.

5. The solid finishing device for jackets according to claim 2, wherein the collar pressers are formed like a butterfly having a pair of right and left vanes to be freely opened or closed by a predetermined angle around the inner pivot shaft in a forward or rearward direction of the torso.

6. The solid finishing device for jackets according to claim 4, wherein the collar pressers are formed like a butterfly having a pair of right and left vanes to be freely opened or closed by a predetermined angle around the inner pivot shaft in a forward or rearward direction of the torso.

* * * * *